United States Patent [19]

Lashyro et al.

[11] Patent Number: 4,919,261

[45] Date of Patent: Apr. 24, 1990

[54] BOTTOM LOADING BASKET CARRIER

[75] Inventors: Jeffrey A. Lashyro, Crosby, Minn.; Norbert Hoell, Southgate, Ky.

[73] Assignee: Minnesota Automation Inc., Crosby, Minn.

[21] Appl. No.: 354,339

[22] Filed: May 23, 1989

[51] Int. Cl.[5] ..... B65D 85/72

[52] U.S. Cl. ..... 206/185; 206/187; 229/120.15; 229/120.18

[58] Field of Search ..... 206/155, 162, 170–189, 206/427, 428, 434; 229/52 BL, 120.18, 120.33, 120.38, 120.15; 53/456–458

[56] References Cited

U.S. PATENT DOCUMENTS

| | | | |
|---|---|---|---|
| Re. 27,624 | 4/1973 | Helms | 206/180 |
| 2,644,631 | 7/1953 | Petter | 206/181 |
| 3,232,477 | 2/1966 | Woodling | 206/178 |
| 3,278,076 | 10/1966 | Graser | 206/187 |
| 3,721,368 | 3/1973 | Arneson | 206/180 |
| 3,981,397 | 9/1976 | Arneson | 206/186 |
| 4,319,682 | 3/1982 | Wright et al. | 206/180 |
| 4,382,505 | 5/1983 | Sutherland et al. | 229/52 BC |

*Primary Examiner*—Stephen Marcus

*Attorney, Agent, or Firm*—Wood, Herron & Evans

[57] ABSTRACT

This invention relates to a basket carrier of the type where each of the carrier's cells is loaded through the carrier's open bottom, the bottom being closed by the carrier's floor after the carrier has been loaded. Preferably, at least one glue tab is foldably connected to one of the floor and the center wall, the glue tab being glued to the other of the floor and the center wall after the carrier has been loaded with bottles. This securely connects the carrier's center wall to the floor which enhances the vertical support for bottles within the carrier cells, and also which aids in maintenance of squared corners for the carrier during use.

6 Claims, 5 Drawing Sheets

BOTTOM LOADING BASKET CARRIER

This invention relates to bottle carriers. More particularly, this invention relates to basket style bottle carriers.

There are innumerable different bottle and can carrier structures known to the prior art, those carriers being commonly used by the beverage industry in marketing of, e.g., beer and soft drink products. Of the various types of carriers used in the beverage industry, one of the most common types is known in the trade as a basket style carrier. The basket carrier includes opposed side walls, opposed end walls and a floor with partitions interiorly of the walls defining multiple cells. This style carrier commonly includes six or eight cells, the cells being provided in two side-by-side rows of three or four cells each which are divided by a center wall. In use, a beverage bottle is positioned within each open-top cell, and is supported within that cell by the carrier's floor. A handle is provided in the center wall to permit easy lifting and carrying of a fully loaded carrier by a retail consumer.

It is conventional in the beverage industry to use basket carriers which require top loading by the bottler. In other words, conventional basket carriers require a bottler to insert filled bottles into, and remove empty bottles from, the carrier's cells from the carrier's top, i.e., the bottles are lifted in and out of the carrier's cells. As a practical matter, and according to common commercial practice, a basket carrier is produced by a carton manufacturer. The carton manufacturer glues or otherwise connects the basket carrier's floor together so that when the carrier is erected the floor is fully assembled with the carrier and ready to support bottles in the carrier. The basket carrier is structured by the carton manufacturer so that it can be knocked down or flattened when it is shipped. A next step in commercial practice, and where glass bottles are to be used with the carriers, is for the carton manufacturer to ship the flattened basket carriers to a bulk glass bottle facility, e.g., a glass bottle manufacturer. It is at the bottle manufacturer that the basket carriers are erected, and empty glass bottles are placed in each of the erected carrier cells. The basket carriers, now filled with empty glass bottles, are shipped from the glass bottle manufacturer to the beverage bottler. Subsequently, the bottler removes or lifts the empty bottles up out of the top loading basket carrier, then fills those bottles with beverage, e.g., beer or soft drink, and then replaces the filled bottles into the erected carrier. The bottler then distributes the now-filled carriers to retailers, e.g., grocery stores and the like, for purchase by retail consumers. So in the ordinary course of business the basket carriers are first shipped in fully assembled but flattened configuration to the bulk glass bottle manufacturer who then erects those carriers and fills same with empty bottles. The bottle manufacturer then ships the empty bottles to the bottler in the basket carriers. The bottler thereafter first lifts out the empty bottles from the bottle carriers, then fills those bottles with beverage, e.g., beer or soft drink, and thereafter drops the filled bottles back into the top loading style basket carriers. A typical top loading basket carrier of this type is illustrated in U.S. Pat. No. 4,319,682.

There is also known to the prior art a basket carrier which can be loaded from the bottom. This bottom loading style basket carrier provides a couple of very important commercial advantages to the bottler, and to the bottle manufacturer, from labor savings and machinery cost standpoints. With a bottom loading basket carrier, the carton manufacturer produces the basket carrier in a knock down shipping attitude just as with the top loading basket carrier. In use, the bottom loaded basket carrier, when erected and with the bottom open, is simply slipped down over a series of bottles so that one bottle is positioned in each cell of the basket carrier. Thereafter, the carrier's floor panel is closed and connected so that the bottles can be carried by a retail consumer in regular fashion. So the floor of the bottom loading basket carrier is not closed or sealed when it leaves the carton manufacturer, i.e., the floor can be opened relative to the carrier's cells so that any bottles loaded into the basket carrier from the top would simply drop out the bottom if the carrier was erected and loaded, and then used without sealing or locking the carrier's floor. The bottom loading basket carrier is commonly shipped direct to the bottler, i.e., it is not first shipped to the glass bottle manufacturer for pre-loading of empty bottles. This allows the glass bottle manufacturer to simply ship bottles in bulk to the bottler without pre-loading same in the basket carriers. This, in turn, results in labor savings at the glass bottle manufacturer's end and at the bottler's end, and also allows less packaging machinery to be needed by the bottler and by the bottle manufacturer. This for the reasons that the bottles are not pre-loaded at the bottle manufacturer's end and therefor need not be lifted out of the carriers prior to filling at the bottler's end.

The prior art bottom loading basket carriers known to ourselves all have floor lock systems which allow the floor to be interconnected so bottles do not drop out of the carrier after it has been loaded. But the floor lock systems known on these prior art bottom loading carriers result in a couple of disadvantages. Specifically, the floor lock systems are not absolutely foolproof, and if the lock system fails then the filled bottles drop out of the carrier when the carrier is lifted either at the bottler or by a retail consumer. And second, the carrier does not always maintain its squareness after the carrier is filled and the carrier's floor panels locked together because the paperboard memory of the carrier tends to return the carrier to the collapsed shipping attitude as opposed to maintain it in the squared use attitude. This lack of carrier squareness is undesirable from the bottler's standpoint in marketing of beverage product to retail consumers.

Accordingly, it has been one objective of this invention to provide a bottom loading basket carrier having two floor panels, one foldably connected to each side wall panel, those floor panels when opened allowing bottles to be inserted through the carrier's bottom into the carrier's cells, those floor panels when closed in floor supporting position being glued to the carrier's center panel and to one another so as to provide better support for the bottles within the carrier, and so as to provide enhanced squareness to the basket's corners during use.

It has been another objective of this invention to provide a basket carrier having at least one glue tab foldably connected to one of the carrier's floor and the carrier's center wall, the glue tab being glued to the other of the floor and the center wall so that the center wall and the floor are firmly interconnected or made integral one with the other, thereby providing a more rigid basket carrier that provides better vertical support for bottles positioned within the carrier's cells and thereby aiding in maintenance of squared corners for the carrier during use.

Other objectives and advantages of this invention will be more apparent from the following detailed description taken in conjunction with the drawings in which.

Figure 1:
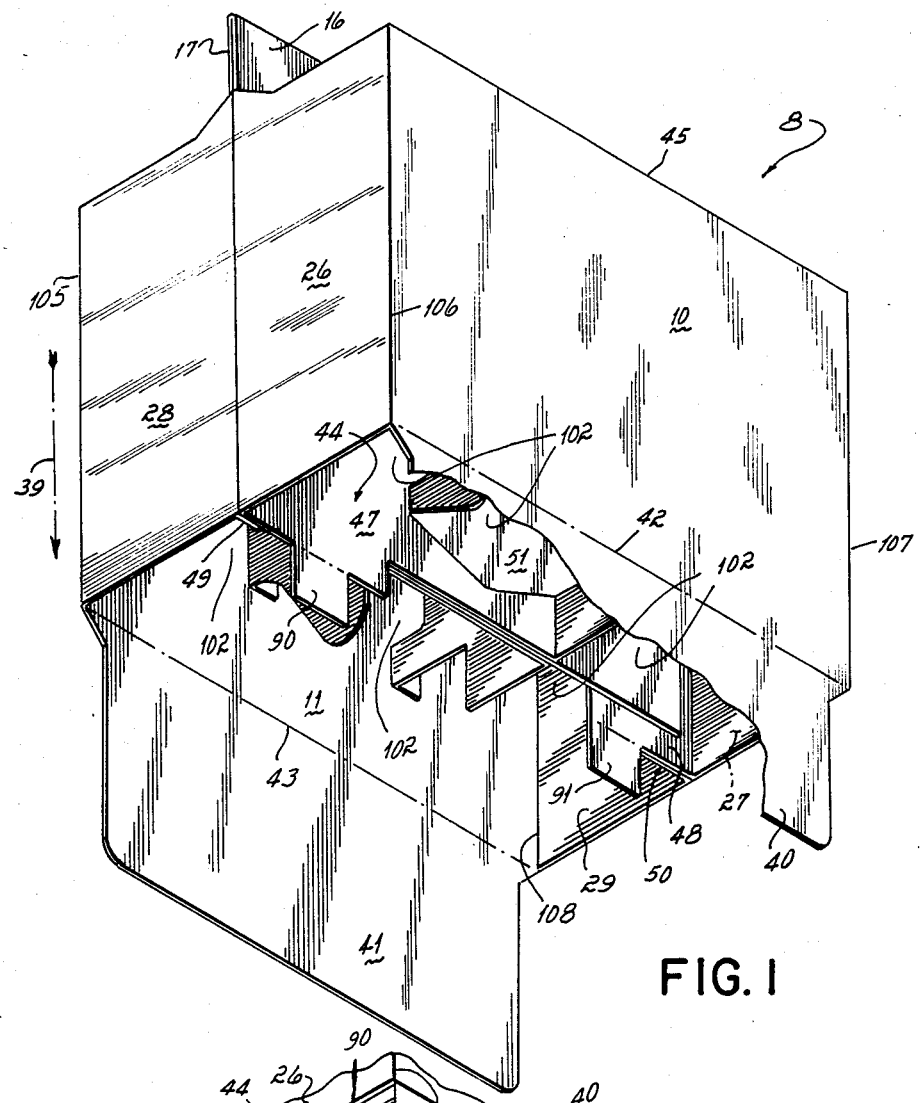
FIG. 1 is a perspective view illustrating a bottom loading basket carrier assembled in accord with the principles of this invention, and in erected or set-up configuration prior to being loaded with bottles.
Figure 3:
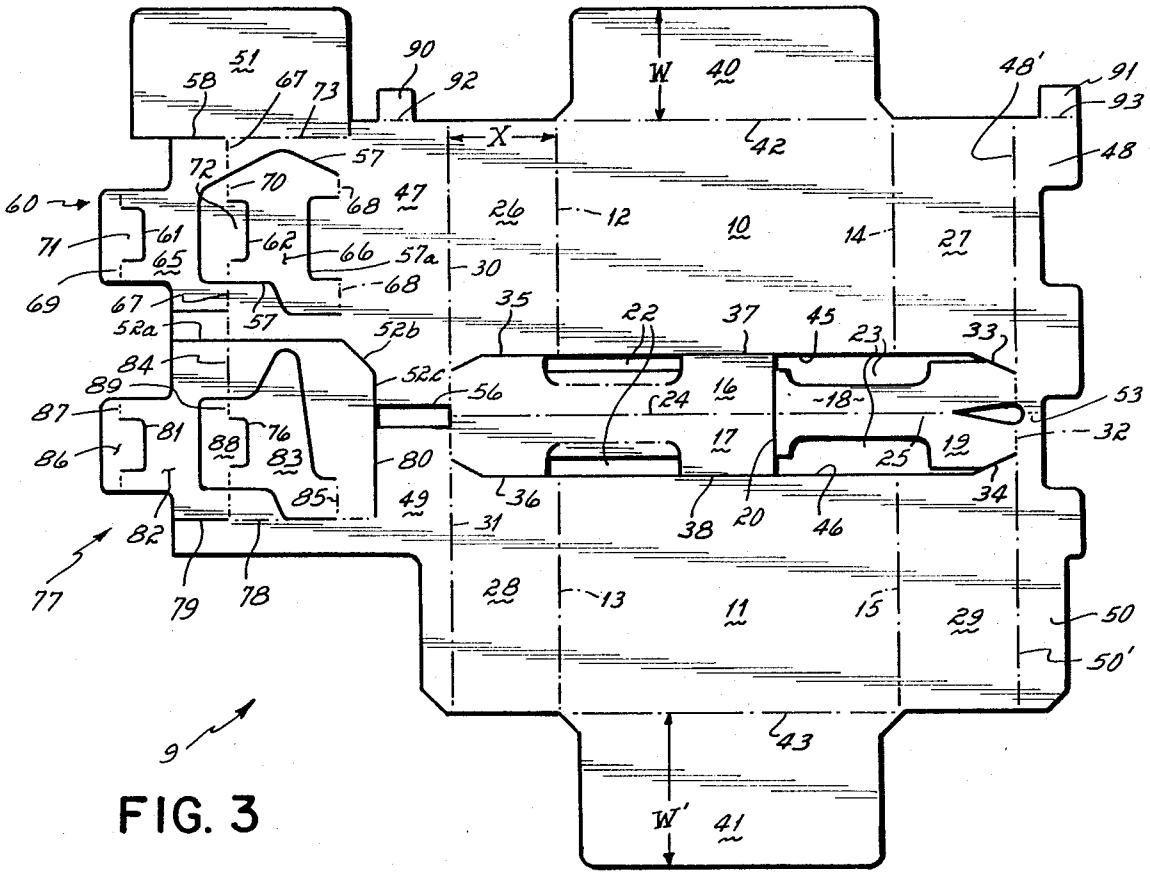
FIG. 3 is a top view of a blank for the carrier of FIG. 1, the blank being shown in as-cut form.
Figure 8:
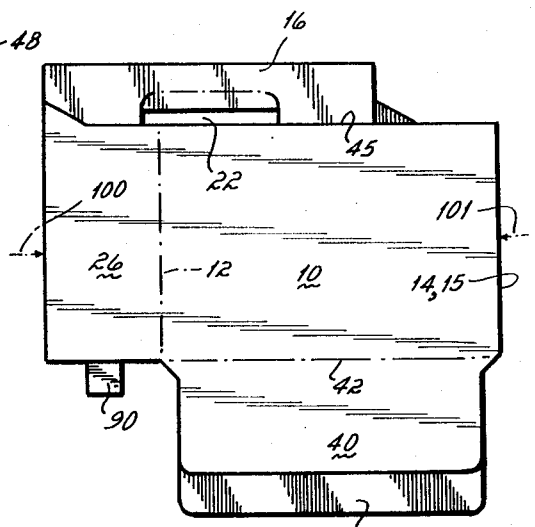
FIG. 8 is a view similar to FIG. 7 but showing the carrier as finally assembled by a carrier manufacturer from the FIG. 3 carrier blank, the carrier being shown in the knock down or shipping configuration.

A bottom loading basket carrier 8 in accord with the principles of this invention is illustrated in FIG. 1 in erected or set up configuration, prior to being loaded with bottles 5, and in FIG. 3 in carrier blank 9 configuration. Gluing of the carrier 8 from the carrier blank 9 configuration into the assembled but knock down carrier configuration shown in FIG. 8 is illustrated in sequence in FIGS. 3–7.

The carrier blank 9 includes side wall panels 10, 11 having respective pairs 12, 13 and 14, 15 of side edges in linear relation one with another. The side panels 10, 11 are separated by handle panels 16, 17 and handle reinforcing panels 18, 19, handle panels 16, 17 being separated from handle reinforcing panels 18, 19 along cut line 20. Each of the handle panels 16, 17, and each of the handle reinforcing panels 18, 19, is provided with hand cut-outs 22, 23, respectively, adapted to overlie one another (see FIG. 7) for access by the carrier's user when the blank 9 is assembled and the carrier 8 is erected and in use. Note the two handle panels 16, 17 are foldably connected one to another by longitudinal fold line 24, and the two handle reinforcing panels 18, 19 are foldably connected one to the other by fold line 25 aligned with the fold line 24, to permit easy folding of those panels 16–19 during assembly of the carrier blank.

The carrier blank 9 also includes pairs 26, 27 and 28, 29 of end wall panels that are connected to respective side wall panels 10 and 11. The end wall panels 26, 27 define the end walls of one row 6 of cells in the erected carrier, and the end wall panels 28, 29 define the end walls of the other cell row 7 in the erected carrier, the end wall panels 26, 28 and 27, 29 thereby respectively defining the end walls of the carrier. Note the end wall panels 26, 27 are foldably connected along fold lines 12, 14 to the side edges of the side wall panel 10, and the end wall panels 28, 29 are foldably connected along fold lines 13, 15 to the side wall panel 11. Note further that the handle panels 16, 17 are foldably connected along fold lines 30, 31 to the end wall panels 26, 28, and the handle reinforcing panels 18, 19 are foldably connected to the end wall panels 27, 28 by fold line 32. The handle reinforcing panels 18, 19 are separated from the end wall panels 27, 29 by cut lines 33, 34. Further, the handle panels 16, 17 are separated from the end wall panels 26, 28 and side wall panels 10, 11 by cut lines 35–38 respectively.

The carrier blank 9 further includes floor panels 40, 41 foldably connected to respective side wall panels 10, 11. The floor panel 40 is connected to side wall panel 10 along that panel's bottom edge fold line 42, and the floor panel 41 is connected to side wall panel 11 along that side wall panel's bottom edge fold line 43. Note particularly floor panel 40 is equal in width W to the width X of the associated end wall panels 26–29, and the floor panel 41 is of a width W′ substantially greater than the width of floor panel 40 but not twice as great in width. It is important to note these floor panels 40, 41 are not glued together by the carton manufacturer when the carrier 8 is in the flattened or knock down shipping attitude shown in FIG. 8. Hence, when the assembled carrier 8 is erected (see FIG. 1) by a bottler prior to loading, the floor panels 40, 41 are opened like doors so the carrier 8 can be lowered (as shown in phantom arrow 39) over a matrix of beverage filled bottles 5.

The carrier 8 is also provided with a center wall 44, when in erected configuration shown in FIG. 1, that is comprised of a series of keel panels 47–50, see FIG. 3. Two of the keel panels 48, 50 are formed integral with end wall panels 27, 29, respectively, thereby orienting those keel panels outboard of, and within the top 45, 46 and bottom 42, 43 edges of the side wall panels 10, 11, respectively. The two keel panels 48, 50 are foldably joined one to the other on fold line 53, and are separated from the respective handle reinforcing panels 18, 19 by fold line 32. The joint line between keel panels 48, 50 and end wall panels 27, 29 is shown by phantom lines 48′, 50′.

The keel panels 47, 49 cooperate with the keel panels 48, 50, and with center reinforcement panel 51, to provide the center wall 44 in the assembled compliance carrier when the blank 9 is glued together in assembled form. The keel panels 47, 49 are foldably connected on fold lines 30, 31, respectively, to the other end wall panels 26, 28, see FIG. 3. Further, the keel panels 47, 49 are foldably connected on that same fold line 30, 31 to the handle panels 16, 17. A slot 56 in the blank 9, and cut lines **52*a*–52*c*, separate the two keel panels 47, 49 one from the other and lets them be foldable relative one to the other on their respective fold lines 30, 31. A cell divider panel section 60 is formed integral with the keel panel 47 in association with one side wall panel 10 of the carrier blank. The cell divider panel section 60 includes two cell divider panels 65, 66 cut from that section 60 (note cut lines 57, 57*a* and 58) which are foldable relative to that section 60 on fold lines 67, 68 that define side edges 67, 68 of those panels. Each of these cell divider panels 65, 66 is also foldably connected at its other side edge along fold lines 69, 70, respectively to glue tabs 71, 72 (note cut lines 61, 62). The center reinforcement panel 51 is connected along fold line 73 to the cell divider panel section 60, that fold line 73 being parallel to the side wall panel's top 45 and bottom 42 edges. Those portions of the cell divider panel section 60 which do not comprise the cell divider panels 65, 66, and the center reinforcement panel 42, cooperate with the keel panel 49 to also form part of the carrier's center wall. Similarly, and in association with side wall panel 11, there is provided a cell divider panel section 77 foldably connected on fold line 78 to keel panel 49, that fold line 78 being parallel to the side wall panel's top 46 and bottom 43 edges. The cell divider panel section 77 is separable from keel panel 49 by cut lines 79 and 80. The cell divider panel section 77 is comprised of cell divider panel 82 and cell divider panel 83 (note cut lines 79, 80), cell divider panel 82 being foldable relative to the section 77 on fold line 84 and cell divider panel 83 being foldable relative to section 77 on fold line 85. The cell divider panel 82 (note cut lines 81) is provided with glue tab 86 connected thereto on fold line 87 and cell divider panel 83 (note cut lines 76) is provided with glue tab 88 connected thereto on fold line 89**.

Importantly with respect to this invention, note particularly that a floor connector tab or glue tab 90 is connected on fold line 92 to keel panel 47, and that a floor connector tab or glue tab 91 is foldably connected on fold line 93 to keel panel 48. These fold lines 92, 93 by which the glue tabs 90, 91 are connected with the respective keel panels 47, 48 are co-extensive with the fold line 42 by which floor panel 40 is connected with side wall panel 10. Since the glue tabs 90, 91 are foldably connected to the keel panels 47, 48, and since those keel panels 47, 48 become an integral part of the basket carrier's center wall 44 when the carrier is assembled, the glue tabs 90, 91 thereby become a part of that center wall and extend downwardly therefrom when the carrier is erected in the bottle loading configuration show in FIG. 1.

Assembly or fabrication of the basket carrier 8 from the blank 9 or as-cut configuration shown in FIG. 3 into the glued knock down configuration shown in FIG. 8 involves a series of separate gluing and folding steps as shown in sequence in FIGS. 4–7.

Figure 4:
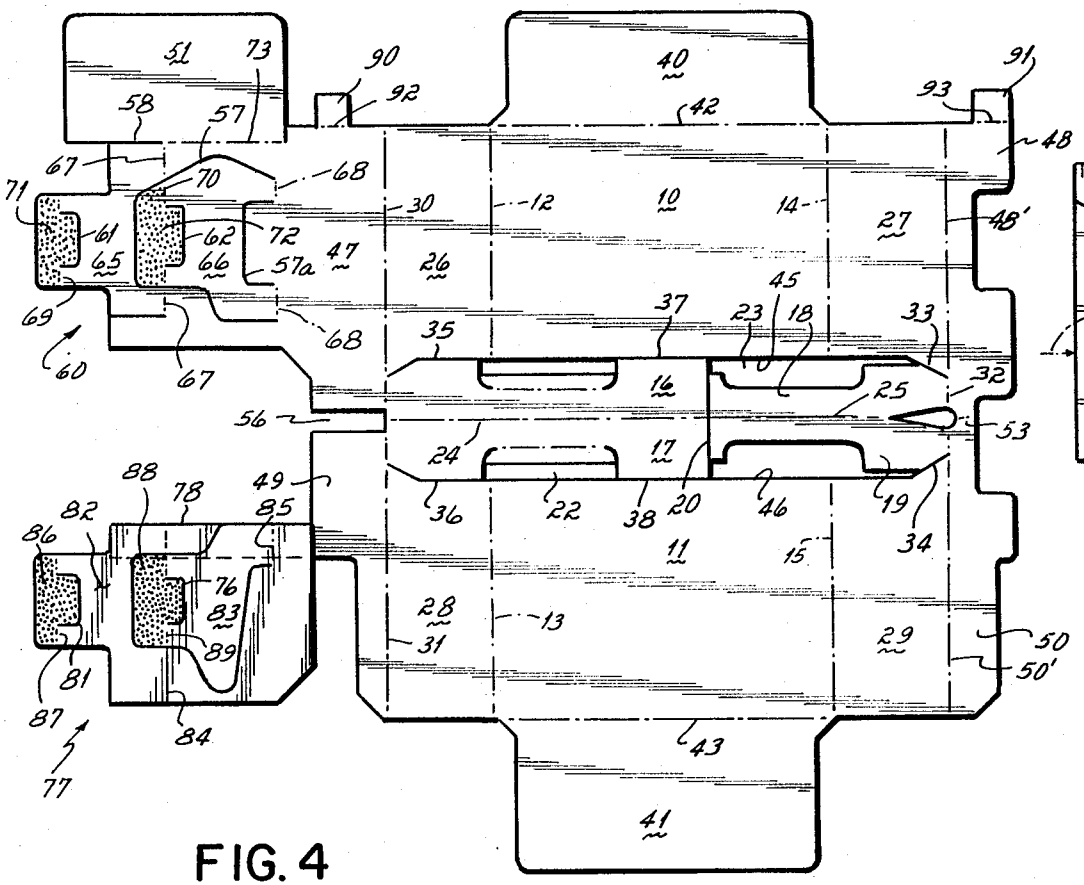
FIG. 4 is a view similar to FIG. 3 showing the blank in a first assembly step.

The initial step is to fold the cell divider panel section 77 on its fold line 78 from the FIG. 3 position into the FIG. 4 position. When in the FIG. 4 position, the glue tabs 71, 72 of cell divider panels 65, 66 of the cell divider panel section 60, and glue tabs 86, 88 of cell divider panels 82, 83 of cell divider panel section 77, are coated with glue as shown by the stippling in FIG. 4. Subsequently, the keel panels 47, 49, and therefor the cell divider panel section 60, 77 connected thereto, are folded on fold lines 30, 31 into the posture illustrated in FIG. 5. In the FIG. 5 position, the cell divider panels' glue tabs 71, 72, 86, 88 are now glued to the inner surfaces of side wall panels 10, 11. Also in this position illustrated in FIG. 5, and after the keel panels 47, 49 have been folded into the position illustrated in that figure, then center reinforcement panel 51 is folded along its fold line 73 over on top of the cell divider panel section 60. This next intermediate configuration of the blank is shown in FIG. 6.

Figure 6:
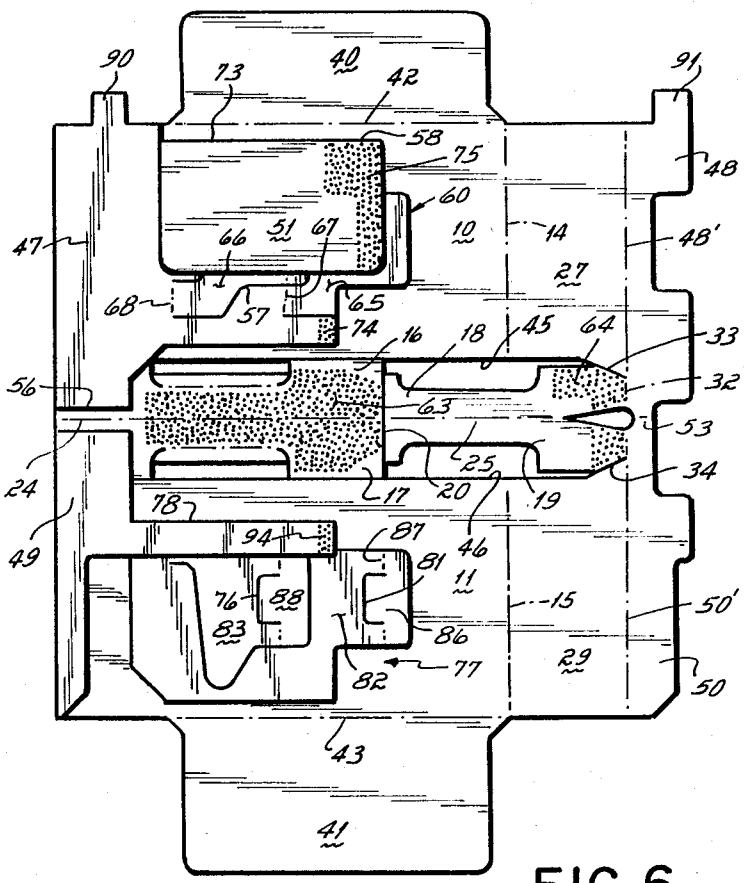
FIG. 6 is a view similar to FIG. 5 showing a third assembly step for the carrier blank.
Figure 5:
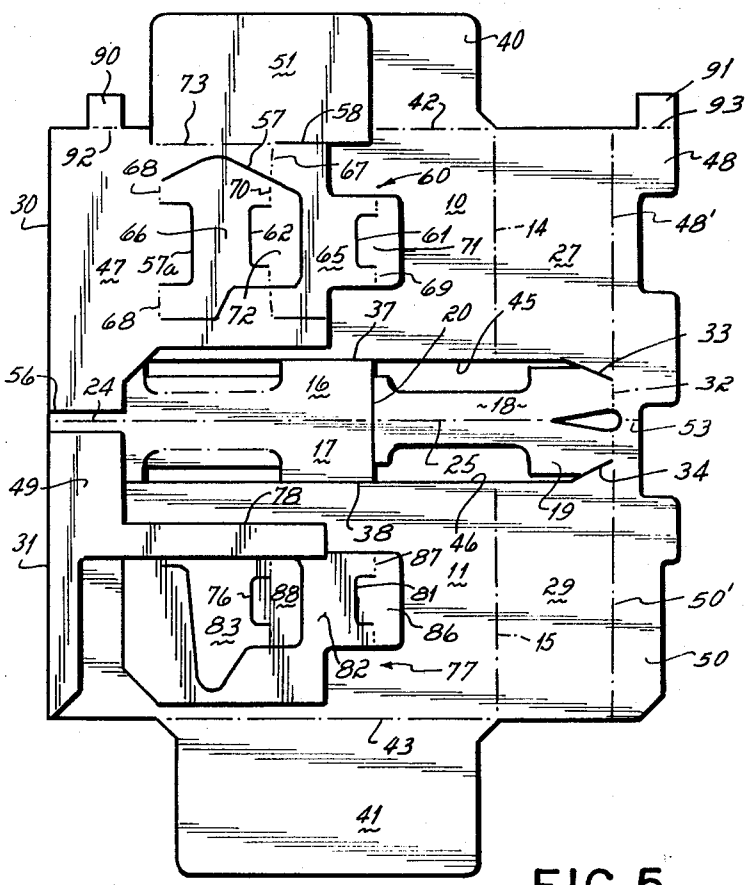
FIG. 5 is a view similar to FIG. 4 showing the blank in a second assembly step.

After the center reinforcement panel 42 has been folded into the FIG. 6 position, one end of that panel is provided with glue as shown by stippling at 75. Further, a small portion of the cell divider panel 60 section is provided with glue as shown by stippling at 74. Further, the handle panels 16, 17 are coated with glue as shown by stippling at 63. Further, the end portion of handle reinforcement panels 18, 19 are provided with glue as shown by stippling at 64. And lastly, a small portion of the cell divider panel section 77 is provided with glue as shown at 94. Subsequently, the handle reinforcement panels 18, 19 are slightly lifted or pivoted up relative to fold line 32, and with those panels partially upraised the end wall panels 27, 29 (and, therefor, keel panels 48, 50 attached thereto) are folded on fold lines 14, 15 into the overlying position shown in FIG. 7. Now in the FIG. 7 position, the handle reinforcing panels 18, 19 will have been glued to the handle panels 16, 17 because of glue area 63, the keel panels 48 will have been glued to the center reinforcing panel 51, and the keel panels 48, 50 will have been glued as at 74, 94 to the cell divider panel sections 60, 77 respectively.

Figure 7:
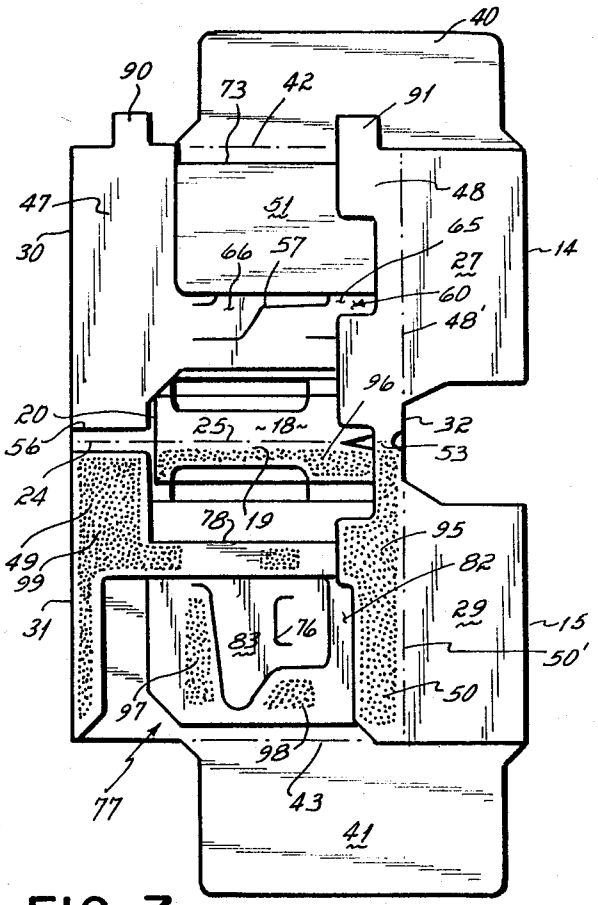
FIG. 7 is a view similar to FIG. 6 showing a fourth assembly step.

With the FIG. 7 intermediate assembly configuration, the blank 9 is ready for the final fold on handle center fold line 24, 25. Prior to this final fold, glue is provided on the keel panel 49 as shown by stippling at 99, glue is provided on the keel panel 50 as shown by stippling at 95, glue is provided on the handle reinforcement panel 19 as shown by stippling at 96, and glue is provided on the cell divider panel section 77 as shown by stippling at 97, 98. Subsequently the top half of the FIG. 7 assembly is folded down over the bottom half of that assembly relative to fold line 24, 25 so that the result is a knock down or flattened basket carrier of the bottom loading type, as shown in FIG. 8, which is ready to be erected when required.

In the flattened or shipping attitude, and as shown in FIG. 8, note particularly that the floor panels 40, 41 are not glued or otherwise connected directly one to the other, that the floor panel 41 has a width W′ significantly greater than the width W of floor panel 40, and that the glue tabs 90, 91 are simply not connected to the floor panels but are in fact integral with the center wall 44.

Figure 2:
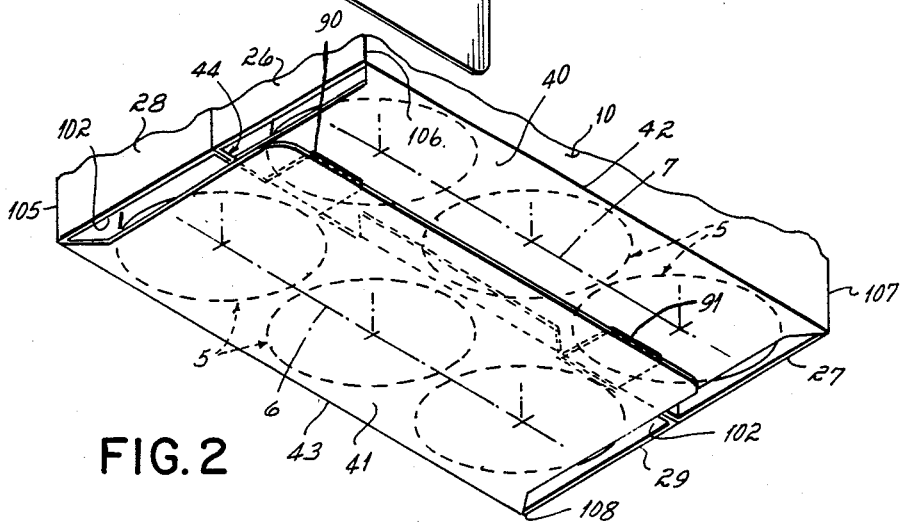
FIG. 2 is a view of the carrier's floor from the same perspective shown in FIG. 1, but with the floor in final glued position after the carrier has been loaded with bottles.

When use of the bottom loading basket carrier 8 is desired, the carrier is first initially erected from the FIG. 8 attitude into the FIG. 1 attitude simply by exposing the carrier to opposite forces on the flattened carrier as shown by phantom arrows 100, 101. Note particularly in the FIG. 1 attitude that the bottom loading basket carrier's floor panels 40, 41 are opened and, in fact, are co-planar with side wall panels 10, 11. In this opened or loading attitude of the basket carrier, each of the individual cells 102 (six being shown in the carrier illustrated herein) are accessible to bottles 5 formed in a three by two matrix. With six bottles 5 positioned in a three by two matrix, the open floor panel basket carrier is simply lowered over that formation in the direction shown by phantom arrow 39 until the carrier's bottom edge 42, 43 is co-extensive with that plane (not shown) within which the bottle 5 matrix is supported. Subsequently, and as shown in FIG. 2, the carriers' floor panels 40, 41 are closed and glued one to the other, and to the center wall's glue tabs 90, 91, to provide an integrated floor support for the carrier. Specifically, the floor panel 40 is first folded on fold line 42 until that floor panel's outer edge is co-extensive with the center wall 44. In this intermediate floor closure attitude, both glue tabs 90, 91 are folded underneath the floor panel 40, and are glued to the floor panel 40. Subsequently, the wide width floor panel 41 is folded on fold line 43 until it contacts the undersurface of floor panel 40 The extra width of the floor panel 41 (relative to the width of floor panel 40) functions as a glue flap so that the floor panel 41 is glued to the underside of the floor panel 40 and to the underside of glue tabs 90, 91. This firmly secures the floor panels 40, 41 together, and also firmly secures the glue tabs 90, 91 to both floor panels 40, 41 as well as trapping the glue tabs therebetween. This final basket carrier structure with bottles 5 therein as shown in FIG. 2, firmly interconnects the floor not only with side walls 10, 11 along fold lines 42, 43, but also, and importantly relative to this invention, with center wall 40 through use of glue tabs 90, 91. This firm interconnection creates a rigidity to the finalized basket carrier 8 (which, it will be recalled, now includes the bottles therein) that provides greater support for those bottles because the floor is now integral with the side walls 10, 11 and with the center wall 44. Further, and importantly, since the floor is now integral with the carrier's center wall 44 there is a degree of squareness provided to the carrier's corners 105–108 which will not be lost due to paperboard memory, i.e., the carrier's corners will be retained in square corner configuration throughout use of the carrier because the carrier no longer has a tendency to collapse back toward the flattened shipping attitude illustrated in FIG. 8 during use.

What is claimed is:

1. A basket carrier comprising opposed side walls and opposed end walls, a center wall disposed between said side walls to provide at least two cells for said carrier, a floor having a first panel foldably connected to one side wall and a second panel foldably connected to the other side wall, said first floor panel being of a width approximately equal to the distance between said center wall and that side wall to which said first floor panel is foldably connected, and said second floor panel being of a width greater than the distance between said center wall and that side wall to which said second floor panel is attached, said first and second panels thereby being sized to overlap one another adjacent the bottom edge of said center wall, said first and second panels being glued to one another where same overlap, and at least one connector tab foldably connected to said center wall, said connector tab being positioned between said first and second floor panels when said floor panels are glued one to the other, each glue tab therefor being glued on a first surface to said first floor panel and being glued on a second surface to said second floor panel, said center wall thereby being securely connected to said floor which enhances the vertical support for bottles positioned within said cells and also which aids in maintenance of squared corners for said carrier during use.

2. A basket carrier set forth in claim 1 comprising at least one cell divider connected between said center wall and a side wall on each side of said center wall to provide at least four cells for said carrier.

3. A basket carrier as set forth in claim 1 comprising a keel panel connected to each end wall, said keel panels cooperating to form at least a part of said center wall, and one connector tab foldably connected to each keel panel, both connector tabs being positioned between said first and second floor panels before same are glued one to the other.

4. A basket carrier blank comprising side wall panels and end wall panels, said side wall panels being positioned parallel one to the other, and said end wall panels being positioned parallel one to the other, when a carrier is erected from said blank, a center wall panel locatable between said side wall panels, and connected to said end wall panels, to provide at least two cells when a carrier is erected from said blank, a floor having a first floor panel foldably connected to one side wall panel and a second floor panel foldably connected to the other side wall panel, said first floor panel being of a width approximately equal to one-half the width of an end wall panel, and said second floor panel being of a width greater than one-half the width of an end wall panel, said first and second floor panels thereby being sized to overlap one another adjacent the bottom edge of said center wall panel so that said first and second floor panels can be glued to one another where same overlap when a carrier is erected from said blank, and at least one connector tab foldably connected to said center wall panel, said connector tab being positionable between said first and second floor panels when said floor panels are glued one to the other when a carrier is erected from said blank, each glue tab therefor being glueable on a first surface to said first floor panel and being glueable on a second surface to said second floor panel when a carrier is erected from said blank.

5. A basket carrier blank set forth in claim 4 comprising at least one cell divider panel connectable between said center wall panel and a side wall panel on each side of said center wall panel to provide at least four cells when a carrier is erected from said blank.

6. A basket carrier blank as set forth in claim 4 comprising a keel panel connected to each end wall panel, said keel panels cooperating to form at least a part of said center wall when a carrier is erected from said blank, and one connector tab foldably connected to each keel panel, both connector tabs being positionable between said first and second floor panels when a carrier is erected from said blank.

* * * * *